United States Patent [19]

McKinney et al.

[11] Patent Number: 4,833,006

[45] Date of Patent: May 23, 1989

[54] FLAKE PROOF FABRIC

[75] Inventors: James M. McKinney, North Augusta; Arthur C. Hatfield, Aiken; Richard D. Samson, North Augusta, all of S.C.

[73] Assignee: Graniteville Company, Graniteville, S.C.

[21] Appl. No.: 154,579

[22] Filed: Feb. 8, 1988

[51] Int. Cl.[4] ..... B32B 27/12; B32B 27/18; B32B 27/32; D06M 15/248

[52] U.S. Cl. ..... 428/226; 427/375; 428/229; 428/257; 428/265; 428/272; 428/423.1; 428/423.7; 428/920

[58] Field of Search ..... 427/375; 428/226, 229, 428/265, 272, 423.1, 423.7, 920

[56] References Cited

U.S. PATENT DOCUMENTS 4,594,286 6/1986 McKinney et al. .

*Primary Examiner*—James C. Cannon

*Attorney, Agent, or Firm*—Clifton Ted Hunt

[57] ABSTRACT

A coated fabric that is flame resistant and water repellant includes a polyfunctional isocyanate as an adhesion promoter and binder to adhere the coating to the substrate in a flake proof manner.

6 Claims, No Drawings

FLAKE PROOF FABRIC

FIELD OF THE INVENTION

This invention relates to coated fabrics that are flame resistant and water repellant and are rendered flake proof by the present invention.

BACKGROUND OF THE INVENTION

It is desired that coated fabrics used for military tenting be flame resistant and water repellant. These desirable properties are effective only while the protective coating remains on the substrate.

U.S. Pat. No. 4,594,286 issued June 10, 1986 to McKinney, et al., and the prior art cited therein, describes and claims specific substrates and coatings that have been used successfully for military tentage and protective clothing.

A principal constituent of the coating disclosed and claimed in U.S. Pat. No. 4,594,286 is a themosetting blocked polyester/polyether urethane prepolymer which bonds the protective coating on the substrate more effectively than had been previously known.

SUMMARY OF THE INVENTION

It has been surprisingly found that the good adhesion and abrasion resisting properties of the said patented formulation are dramatically improved by replacing the blocked urethane prepolymer with an unblocked polyisocyanate adduct.

The fabric of the present invention retains the excellent flame retardance characteristic of the fabric of U.S. Pat. No. 4,594,286, while improving the abrasion resistance and flake resistance of the coating to a level which is, in effect, actually flake proof for all practical purposes.

Specifically, the use of blocked urethane prepolymer in the coating of U.S. Pat. No. 4,594,286 exhibits adhesion resistance in the range of 3 to 5 pounds compared with an adhesion resistance of 8 to 15 pounds with the substitution for the blocked urethane prepolymer of an unblocked polyisocyanate adduct in the otherwise corresponding coating.

DETAILED DESCRIPTION OF THE INVENTION

The fabric of the present invention is structured to meet all of the practical needs of a tent fabric in all climates of the world. To accomplish this, the coating has been specially formulated to achieve film integrity which adheres the coating to the substrate and is impervious to cracking and resistant to abrasion at all temperatures.

The currently preferred substrate to which the coating is applied is woven from essentially untwisted, continuous multifilament polyester yarns that are free to flatten out like miniature ribbons in the fabric. These flat yarns have no more than the normal producers twist of one or two turns per inch. The flat yarns are woven into a fabric containing a minimum of forty-four (44) warp yarns per inch and a minimum of thirty-two (32) filling yarns per inch in a plain weave. Additional polyester fiber based substrates wherein lower weight tent fabrics are desired have been demonstrated.

A plurality of flame retardants are included in the coating composition, each contributing to a flame retardant fabric which meets, or surpasses, the military specifications for tenting. The coating composition also includes plasticizers, binders, stabilizers and a thickening agent, and may also include components to stabilize the coated fabric against heat and ultra-violet degradation, and a mildew inhibitor. To this known composition is combined a small amount of an unblocked polyisocyanate adduct.

The isocyanate (—NCO) content of preferred adducts is 10%–22%. A typical preferred isocyanate adduct would be the reaction product of toluene diisocyanate and trimethylolpropane with a resulting 16.66% NCO content.

A typical general formulation for the protective coating system comprises a base coat and a top coat and is shown in Table I-A (Base Coat) and Table I-B (Top Coat).

TABLE I-A

| COMPONENT | (Base Coat) PERCENT | FUNCTION |
|---|---|---|
| Polyvinyl Chloride Polymer | 08.61 | Flame Retardant Binder |
| Chlorinated Paraffin (40% Chlorine) | 04.40 | Flame Retardant Plasticizer |
| Chlorinated Paraffin (70% Chlorine) | 04.60 | Flame Retardant |
| Di(2-ethylhexylphthalate) | 10.34 | Flame Retardant Plasticizer |
| Antimony Trioxide | 32.62 | Flame Retardant |
| Decabromodiphenyl oxide | 14.38 | Flame Retardant |
| Zinc Oxide | 01.62 | Stabilizer |
| Barium Cadmium Complex | 00.29 | Stabilizer |
| Polyfunctional Isocyanate (16% NCO) | 03.89 | Adhesion Promoter and Binder |
| Dibutyl Phthalate | 09.08 | Plasticizer |
| Organic Acid Chloride | 00.15 | Pot Life Extender |
| Pigment System | 10.02 | Color/IR Properties |
| | 100.00 | |

TABLE I-B

| COMPONENT | (Top Coat) PERCENT | FUNCTION |
|---|---|---|
| Polyvinyl Chloride Polymer | 30.87 | Flame Retardant Binder |
| Polyfunctional Isocyanate | 03.90 | Adhesion Promoter |
| Dibutyl Phthalate | 09.09 | Plasticizer |
| Di(2-ethylhexylphthalate) | 16.46 | Plasticizer |
| Barium Cadmium Complex | 00.08 | Stabilizer |
| Calcium Carbonate | 02.06 | Filler |
| Fumed Silica | 07.59 | Flattening Agent |
| Epoxy Resin | 00.93 | Stabilizer |
| Ethylene Bisstearamide | 01.21 | Water Repellant |
| Wetaid 35 | 00.61 | Wetting Agent |
| Antimony Trioxide | 09.22 | Flame Retardant |
| Decabromodiphenyl Oxide | 08.16 | Flame Retardant |
| Organic Acid Chloride | 00.15 | Pot Life Extender |
| Pigment System | 09.67 | Color I/R Properties |
| | 100.00 | |

The preferred coating systems for the flake proof tent fabric of this invention are shown in Table II-A (Base Coat) and Table II-B (Top Coat).

TABLE II-A

| COMPONENT | (Base Coat) PERCENT | FUNCTION |
|---|---|---|
| Polyvinyl Chloride Polymer | 08.61 | Flame Retardant Binder |
| Chlorinated Paraffin (40% Chlorine) | 04.40 | Flame Retardant Plasticizer |
| Chlorinated Paraffin (70% Chlorine) | 04.60 | Flame Retardant |
| Di-(2-ethylhexylphthalate) | 19.42 | Flame Retardant Plasticizer |

TABLE II-A-continued

| COMPONENT | (Base Coat) PERCENT | FUNCTION |
|---|---|---|
| Antimony Trioxide | 32.62 | Flame Retardant |
| Decabromodiphenyloxide | 14.38 | Flame Retardant |
| Zinc Oxide | 01.62 | Stabilizer |
| Barium Cadmium Complex | 000.029 | Stabilizer |
| Polyfunctional Isocyanate | 03.89 | Adhesion Promoter |
| Pigment System | 10.17 | Color I/R Properties |
| | 100.00 | |

TABLE II-B

| COMPONENT | (Top Coat) PERCENTAGE RANGE | FUNCTION |
|---|---|---|
| Polyvinyl Chloride | 43.75–42.54 | Flame Retardant |
| Polymer | | Binder |
| Di(2-ethylhexylphthalate) | 22.95–23.34 | Plasticizer |
| Barium Cadmium Complex | 01.28–01.25 | Plasticizer |
| Calcium Carbonate | 01.81–01.76 | Filler |
| Fumed Silicia | 04.45–04.32 | Flattening Agent |
| Epoxy Resin | 00.81–00.80 | Stabilizer |
| Ethylene Bisstearamide | 01.32–01.27 | Water Repellant |
| Wetaid 35 | 00.54–00.53 | Wetting Agent |
| Decabromodiphenyl Oxide | 06.76–06.57 | Flame Retardant |
| Antimony Tri-oxide | 07.32 | Flame Retardant |
| Zinc Borate | 09.49 | Flame Retardant |
| Pigment System | 09.01–09.13 | Color/IR Properties |
| | 100.00 100.00 | |

The compositions of Tables I-A, I-B, II-A, and II-B are shown without solvent carriers.

The top and bottom coating systems of Tables I and II are both preferably applied in a liquid state to the tightly woven substrate so as to penetrate the interstices of the substrate. The processing temperature of 375° F. fuses the coating composition to the substrate and the unblocked polyisocyanate adduct immediately adheres the entire composition to the substrate in a flake proof manner during normal use in all climates.

The unblocked polyisocyanate adduct has the immediate availability of terminal isocyanate groups which promote immediate and strong coating adhesion to the substrate and overall film integrity. There is no polyfunctional polyisocynate in the preferred top coat of the formulations.

The adhesion strength of a protective coating to its substrate is measured for purposes of this invention by the following method:

1. Cut a 9"×9" sample of an uncoated substrate.
2. Apply a 30 mil thickness of the plastisol or organisol coating being tested to the substrate.
3. Dry and fuse the coating to the substrate for 60 seconds at 350° F.
4. Mark off a 2 inch section and carefully cut through only the 30 mil coating to define a tongue.
5. Pull enough of the coating from the substrate to fasten the free end of the coating in the clamp of an Instron tester.
6. Fasten the free ends of the coating and the substrate in the jaws of the Instron tester and start the machine to separate the two ends at 12 inches (±0.5 inch) per minute.
7. Pull at least two (2) inches of the coating from the substrate.
8. Record the pounds of pull as the coating adhesion.

When tested in this manner, the coatings of Tables I and II uniformly showed a coating adhesion of between 8 and 15 pounds. The same test on the coating of U.S. Pat. No. 4,594,286 showed a coating adhesion of between 3 and 5 pounds.

The dramatically improved adhesion provided by the polyfunctional isocyanate is due to the immediate availability of terminal isocyanate groups in the unblocked polyisocyanate adduct. In the previous blocked isocyanate prepolymer and blocked versions of the current polyisocyanate adduct the reactivity of the regenerated isocyanate terminals is inhibited until the blocking agent is fully exhausted.

The proper use of unblocked polyisocyanate adducts provides a flake proof coated fabric. The material described in U.S. Pat. No. 4,594,286, by comparison, is characterized as flake resistant.

The woven substrate weighs about eight (8) ounces per square yard and the average weight of the substrate plus the protective coating is about thirteen (13) ounces per square yard when made for military tents. The polyfunctional isocyanate effectively binds the coating to the substrate in all climates of the world, which is ideal for military tenting and protective clothing.

The coated fabric may be heavier if desired, as for use in tarpaulins and the like, or lighter for other purposes.

We claim:

1. In a coated fabric which is water repellant and flame retardant and formed from a substrate woven from yarns of synthetic fibers and having a protective coating system containing a polymeric binder, flame retardant chemicals and water repellant chemicals, the improvement wherein the protective coating system is derived from a combination of an unblocked polyisocyanate adduct adhesion promoter and a binder whereby the coating is adhered to the substrate in a flake proof manner.

2. A coated fabric according to claim 1 wherein the adhesion promoter is an unblocked polyisocyanate adduct which is the reaction product of toluene diisocyanate and trimethylolpropane with a resulting isocyanate content of 16%.

3. A coated fabric according to claim 1 wherein the isocyanate content of adduct is between 10 and 22%.

4. A coated fabric according to claim 1 wherein the protective coating system includes a base coat and a top coat.

5. A coated fabric according to claim 4 wherein an unblocked polyfunctional isocyanate adduct is used to form both coats.

6. The method of producing the coated fabric of claim 1 wherein the fabric is contacted with a coating system containing a unblocked polyisocyanate adduct with an isocyanate content of 10 to 20%, and the coating is fused to the fabric at an elevated processing temperature, whereby the protective coating system is adhered to the fabric in a flake proof manner.

* * * * *